US010253567B2

(12) United States Patent
Lasater et al.

(10) Patent No.: US 10,253,567 B2
(45) Date of Patent: Apr. 9, 2019

(54) STEERING ASSEMBLY FOR DIRECTIONAL DRILLING OF A WELLBORE

(71) Applicant: Kinetic Upstream Technologies, LLC, Houston, TX (US)

(72) Inventors: Jeffrey B. Lasater, Houston, TX (US); Ronald G. Earles, Houston, TX (US); Jayson Byrd, Humble, TX (US)

(73) Assignee: Kinetic Upstream Technologies, LLC, Houston, TX (US)

( * ) Notice: Subject to any disclaimer, the term of this patent is extended or adjusted under 35 U.S.C. 154(b) by 511 days.

(21) Appl. No.: 14/797,623

(22) Filed: Jul. 13, 2015

(65) Prior Publication Data

US 2016/0102501 A1 Apr. 14, 2016

Related U.S. Application Data

(63) Continuation of application No. 14/510,561, filed on Oct. 9, 2014, now Pat. No. 9,109,402.

(51) Int. Cl.

| | |
|---|---|
| ***E21B 7/06*** | (2006.01) |
| ***E21B 17/10*** | (2006.01) |
| ***E21B 44/00*** | (2006.01) |
| ***E21B 47/024*** | (2006.01) |

(52) U.S. Cl.

CPC ..... *E21B 7/061* (2013.01); *E21B 7/062* (2013.01); *E21B 7/067* (2013.01); *E21B 17/1014* (2013.01); *E21B 17/1078* (2013.01); *E21B 44/005* (2013.01); *E21B 47/024* (2013.01)

(58) Field of Classification Search

CPC ..... E21B 17/10; E21B 7/06

See application file for complete search history.

(56) References Cited

U.S. PATENT DOCUMENTS

| | | | |
|---|---|---|---|
| 5,529,133 | A | 6/1996 | Eddison |
| 5,963,138 | A | 10/1999 | Gruenhagen |
| 5,979,570 | A | 11/1999 | McLoughlin et al. |
| 6,092,610 | A | 7/2000 | Kosmala et al. |

(Continued)

FOREIGN PATENT DOCUMENTS

| | | | |
|---|---|---|---|
| GB | 2433082 | A | 6/2007 |
| WO | 1996030616 | A1 | 10/1996 |

(Continued)

OTHER PUBLICATIONS

PCT International Search Report and Written Opinion; PCT/US2015/054119; dated Dec. 23, 2015.

(Continued)

*Primary Examiner* — David J Bagnell
*Assistant Examiner* — Ronald R Runyan
(74) *Attorney, Agent, or Firm* — Pramudji Law Group PLLC; Ari Pramudji

(57) ABSTRACT

A steering assembly includes a housing having a longitudinal axis, a mandrel having a front connecting extremity and a rear connecting extremity, the mandrel passing through the housing and arranged in a first position coaxially to the longitudinal axis of the housing, a deflector device configured to exert a side force on the mandrel to offset the front connecting extremity of the mandrel from the longitudinal axis, and a tool face assembly configured to rotate the front connecting extremity of the mandrel in a desired direction.

16 Claims, 7 Drawing Sheets

(56) References Cited

U.S. PATENT DOCUMENTS

| | | | | |
|---|---|---|---|---|
| 6,158,533 | A * | 12/2000 | Gillis | E21B 7/068 175/325.1 |
| 6,328,119 | B1 | 12/2001 | Gillis et al. | |
| RE38,567 | E | 8/2004 | Gruenhagen | |
| 6,808,027 | B2 | 10/2004 | Mcloughlin et al. | |
| 6,945,338 | B1 | 9/2005 | Defourny et al. | |
| 7,188,685 | B2 | 3/2007 | Downton et al. | |
| 7,287,605 | B2 | 10/2007 | Van Steenwyk et al. | |
| 7,916,041 | B2 | 3/2011 | Downton | |
| 2004/0262043 | A1 | 12/2004 | Schuaf | |
| 2006/0090935 | A1 | 5/2006 | Van Steenwyck et al. | |
| 2008/0083567 | A1 | 4/2008 | Downton et al. | |
| 2009/0166089 | A1 | 7/2009 | Millet | |
| 2010/0236830 | A1 | 9/2010 | Haughom | |
| 2011/0240368 | A1 | 10/2011 | Allen et al. | |
| 2013/0105220 | A1 | 5/2013 | Aldred et al. | |
| 2013/0319764 | A1 * | 12/2013 | Schaaf | E21B 7/06 175/24 |
| 2014/0158427 | A1 | 6/2014 | Zaki et al. | |
| 2014/0182941 | A1 | 7/2014 | Oppelaar | |
| 2014/0209389 | A1 * | 7/2014 | Sugiura | E21B 7/067 175/73 |

FOREIGN PATENT DOCUMENTS

| | | | |
|---|---|---|---|
| WO | 2000037764 | A2 | 6/2000 |
| WO | 2003052237 | A1 | 6/2003 |
| WO | 2013007269 | A2 | 1/2013 |
| WO | 2013122603 | A1 | 8/2013 |

OTHER PUBLICATIONS

English translation of first Chinese Office Action for Chinese Patent Application No. 201580067283.4, dated Sep. 4, 2018.

* cited by examiner

STEERING ASSEMBLY FOR DIRECTIONAL DRILLING OF A WELLBORE

CROSS REFERENCE TO RELATED APPLICATIONS

This application claims benefit, under 35 U.S.C. § 120, of U.S. application Ser. No. 14/510,561, filed Oct. 9, 2014, which is incorporated by reference herein in its entirety.

FIELD OF THE INVENTION

The present invention relates to the field of directional drilling systems and to a method for controlling the direction while drilling a vertical or horizontal wellbore. More particularly, the present invention is related to a steering assembly to be included in a drill string for directional drilling.

BACKGROUND

Directional drilling systems are systems well known in the art of drilling oil and gas wellbores. Such a system generally comprises a drillstring with a bottom hole assembly (BHA) comprising a steering assembly and a drill bit attached to the bottom end of the drillstring.

In directional drilling, the bottom hole assembly generally comprises a measurement while drilling assembly (MWD) comprising sensors for measuring information about the direction (inclination and azimuth) of the wellbore and other downhole drilling parameters, and comprises telemetry transmitters for transmitting sensor data uphole to a surface control unit. Additionally, for directional control, a conventional bottom hole assembly comprises a downhole motor and bent sub coupled to a shaft for rotating the drill bit. Optionally, a rotary steerable system (RSS) may either replace or be used in combination with the downhole motor to provide steering control. The advantage of the RSS is to allow directional steering control while rotating the entire drillstring, whereas the downhole motor alone is only steerable by holding the drillstring fixed in a particular direction (or toolface) from the surface. The benefits of continuously rotating the drillstring are numerous including a large reduction in friction between the drillstring and the borehole, which permits the drilling of longer distance horizontal wells.

Rotary Steerable Systems generally comprise a tubular housing enclosing a shaft having a front end connected directly or indirectly to the drill bit. Various kinds of steering mechanisms can be included in the housing to change the orientation of the front end of the shaft to change the direction of drilling. A first category of rotary steerable systems is configured to work in a "push the bit" mode, and a second category of rotary steerable systems is configured to work in a "point the bit" mode. In push the bit mode, the bit dominant factor of steering is a side (or lateral) force imparted to the bit. In point the bit mode, the dominant factor for steering is an angular change or tilting of the bit. Each category of rotary steerable systems is comprised of further sub-categories.

For the rotary steerable systems configured to work in push the bit mode, the housing comprises pads or some other offset mechanism which can be selectively activated for applying a reactive side force on the shaft, thus changing the orientation of the drill bit.

A first sub-category of push the bit rotary steerable systems comprises a non-rotating (or slowly rotating) housing provided by a plurality of pads distributed around the circumference of the housing and directed towards the wellbore. The pads are selectively actuated to push against the wellbore formation and change the orientation of the housing which deflects the shaft and provides the required side force on the drill bit, thus deflecting the drill bit sideways in a preferred direction of drilling.

A second sub-category of push the bit rotary steerable system comprises a non-rotating (or slowly rotating) housing provided by a fixed body-mounted stabilizer and a deflection device inside the circumference of the housing and directed towards the shaft. The internal deflection device is selectively actuated to push the shaft away from the center of the stabilized housing and thus the center of the wellbore, providing a side force on the drill bit.

Another sub-category of push the bit rotary steerable system comprises a rotating housing provided by a plurality of pads distributed around the circumference of the housing and directed towards the wellbore. The pads rotate with the housing and can independently move from a retracted to an extended position, bearing against the wellbore formation and pushing the housing laterally off-center from the wellbore, thus changing its orientation. The system further comprises a control means that actuates one pad when the pad crosses a selected radial angle such that the pad pushes against the wellbore towards a selected direction to change the orientation of the housing which deflects the shaft and provides the required offset force at the drill bit. While drilling in soft formations, it may not be suitable to use a steering system which pushes pads against the wellbore, especially when rotating said pads.

For the rotary steerable systems configured to operate in point the bit mode, the primary method used to tilt the drill bit is to bend the shaft inside a centralized non-rotating (or slowly rotating) housing, thus angularly deflecting the shaft away from the centerline axis of the wellbore. In that case, the non-rotating housing includes some form of anti-rotation means and a mechanism for deflecting the shaft inside the non-rotating housing. In this case, bending while rotating the shaft can cause fatigue on the shaft, and the shaft may break or get deformed after a certain time of use. Workarounds include the use of costly materials and may require an increased shaft diameter this limiting the available cross-section for offset mechanisms, power, and instrumentation.

Beside the category of "push the bit" and "point the bit" rotary steerable systems, there also exist hybrid rotary steerable systems that are capable of steering like both a push the bit and point the bit system, depending on configuration. An example of such a hybrid rotary steerable system is disclosed in U.S. Pat. No. 7,188,685. This rotary steerable system comprises an upper section connected to a steering section and a drill bit connected to the steering section. The upper section is connected to a collar on which an upper stabilizer is provided. The steering section comprises a lower stabilizer and is connected to the upper section by a swivel which is a two degree of freedom universal joint, such that the swivel is located between the lower stabilizer and the drill bit. Pistons are located between the steering section and the upper section and are actuated to push against the steering section which pivots on the universal joint. The steering section tilts until the lower stabilizer contacts the formation at which point the pistons act to push the bit through the formation. As the formation is drilled, the constraint imposed by the formation is removed, the periphery of the steering section is allowed to tilt further and the tool then begins to steer as a point the bit system. Rotation of the steering section against the pads causes friction that can produce wear of those parts and vibration of the steering section which can influence the quality of the borehole.

It is desirable to provide a rotary steerable system that doesn't present the drawbacks of prior art devices, and which provides:

- wellbore steering in either push the bit or point the bit mode;
- a point the bit mode which minimizes internal cyclic bending stresses;
- relatively high turn rates (or dogleg severity);
- a configuration that is easily field serviceable;
- the capability to vary turn rate (or dogleg severity) while providing independent directional tool face control and;
- good control of the direction of drilling with less vibration.

SUMMARY OF THE INVENTION

According to a first aspect, the present invention is related to a Steering assembly 100 comprising a housing 136 having a longitudinal axis 101 and a mandrel 102 comprising a front connecting extremity 103 and a rear connecting extremity 104, the mandrel 102 passing through the said housing 136 and arranged in a first position coaxially to the said longitudinal axis 101 of the housing 136, the steering assembly being characterized in that it comprises:

- a deflector device for giving a side force to the said mandrel 102 such as to bring the said front connecting extremity 103 of the said mandrel 102 offset from the said longitudinal axis 101, and
- a tool face assembly for rotating the said front connecting extremity 103 of the said mandrel 102 towards a desired direction;
- the said mandrel 102 being rotatable relative to the said housing, the said deflecting assembly and the said tool face assembly.

Preferably, the mandrel 102 is connected to the housing 136 through a bearing pack comprising a spherical seat 105 arranged around a set of ball bearings 130.

Preferably, the said toolface assembly comprises:

- an orienting sleeve 106 at least partially included in the said housing 136 and arranged around the said mandrel 102, the said orienting sleeve 106 comprising a first sleeve section 106*a* having a bore coaxial with the said longitudinal axis 101 of the housing 136 and a second sleeve section 106*b* having a bore coaxial to a second axis 137 inclined relative to the said longitudinal axis 101 of the housing 136; and
- an actuating system for rotating the said orienting sleeve 106;

Preferably, the said deflector device is a deflecting assembly comprising:

- a deflecting sleeve 107 arranged around the said mandrel 102 and coaxially to the said second axis 137 and;
- an actuating system for moving the said deflecting sleeve 107 along the said second axis 137.

Preferably, the said actuating system for rotating the said orienting sleeve 106 comprises a first geared actuator 108 that engages a geared surface 109 of the said orienting sleeve 106.

Preferably, the said actuating system for moving the said deflecting sleeve 106 along the said second axis 137 comprises:

- a first actuating sleeve 110 surrounding the said mandrel 102 and at least partially included into the said first sleeve section 106*a* of the orienting sleeve 106, the said first actuating sleeve 110 comprising:
  - a geared surface 111, and
  - a geared extremity 112 directed towards the bore of the second sleeve section 106*b* of the said orienting sleeve 106;
- a second geared actuator 113 that engages the said geared surface 111 of the first actuating sleeve 110;
- a second actuating sleeve 114 surrounding the said mandrel 102, included into the said second sleeve section 106*b* of the orienting sleeve 106, retained by an abutment 115 into the said second sleeve section 106*b* and disposed around the said deflecting sleeve 107, the second actuating sleeve 114 comprising:
  - a geared extremity 116 that engages the said geared extremity 112 of the said first actuating sleeve 110 and;
  - a spiral guiding means 117 provided on its the inner surface;
  - a linear guiding means 118 provided into the said second sleeve 106*b* section of the orienting sleeve 106;

Preferably, the said deflecting sleeve 107 comprises:

- a first side comprising a spiral cam follower 119 that engages into the said spiral guiding means 117 in the second actuating sleeve 114;
- a second side comprising a second cam follower 120 that engages with the said linear guiding means 118.

Preferably, an assembly of a spherical seat 121*a* and ball bearing 121*b* is arranged between the said deflecting sleeve 107 and the said mandrel 102.

Preferably, the external surface of the said housing 136 further comprises bore contact pads 122.

Preferably, the said housing 136 further comprises one or more enclosures 123 including a battery 124, a control electronic assembly 125 and a motor 126, 127.

Preferably, the steering assembly comprising a first motor 126 and a first geared actuator 108 dedicated for rotating the said orienting sleeve 106, and a second motor 127 and a second geared actuator 113 dedicated for rotating the first actuating sleeve 110 of the actuating system for actuating the deflecting sleeve 107.

In a first possible configuration, the steering assembly further comprises a pivot stabilizer sub 131 connected to the said rear extremity 104 of the mandrel 102.

In a second possible configuration, the steering assembly further comprises a pivot sub 135 connected to the said front extremity 103 of the mandrel 102 and connected to a near bit stabilizer sub 133 having its blades 134 away from the pivot point 139 of the pivot sub 135, and itself connected to a drill bit 200.

Preferably, the said housing is configured for not rotating in the wellbore and serves as a reference point for steering the bit.

More preferably, the steering assembly further comprises a control electronic assembly 125 configured for measuring any undesirable rotation of the housing in the wellbore, calculating the correction to apply to steer the bit in the desired direction and to apply these corrections to the said deflecting assembly and tool face assembly.

In a second aspect, the present invention relates to a method for directionally drilling a wellbore by providing the steering assembly 100 in a drillstring as presented in the present disclosure, and wherein the magnitude of the directional steering is changed by operating the said deflector device.

In the method of the present invention, the steering direction can be further changed by operating the said tool face assembly.

In a first embodiment of the method of the present invention, the said steering assembly 100 is used in a push the bit configuration with the said front extremity 103 of the mandrel 102 connected to a drill bit 200.

In a second embodiment of the method according to the present invention, the said steering assembly 100 is used in a point the bit configuration wherein the said front extremity 103 of the mandrel 102 is connected to a second pivot sub 135 itself connected to a near-bit stabilizer sub 133, itself connected to a drill bit 200.

The present invention can also be described as a steering assembly 100 comprising a housing 136 having a longitudinal axis 101 and a mandrel 102 comprising a front connecting extremity 103 and a rear connecting extremity 104, the mandrel 102 passing through the said housing 136 and arranged in a first position coaxially to the said longitudinal axis 101, a deflector device for giving a side force to the said mandrel 102 in the housing 136 such as to bring the said front connecting extremity 103 of the said mandrel 102 offset from the said longitudinal axis 101, characterized in that it further comprises a pivot stabilizer sub connected to the rear extremity of the mandrel.

Preferably, the said pivot stabilizer sub is arranged outside of the housing.

In another embodiment of the invention, the front extremity 103 of the mandrel 102 is connected to a pivot sub 135, itself connected to a near bit stabilizer 133 which is directly connected to a drill bit 200. Further, the near bit stabilizer and the bit may be combined into one unit.

Preferably, the said housing is configured for not rotating or slowly rotating within the wellbore and serves as a reference point for steering the bit.

Preferably, the steering assembly comprises:

- a deflector device for producing a side force to the said mandrel 102 into the housing 136 such as to bring the said front connecting extremity 103 of the said mandrel 102 offset from the said longitudinal axis 101, and
- a tool face assembly for rotating the said front connecting extremity 103 of the said mandrel 102 towards a desired direction;

the said mandrel 102 being rotatable relative to the said housing, the said deflector device and the said tool face assembly.

Preferably, the steering assembly comprises a control device configured for measuring any undesirable rotation of the housing in the wellbore, calculating a correction to apply to steer the bit in the desired direction and to apply these corrections to the said deflector device and tool face assembly.

In a method for drilling directionally a wellbore according to the present invention, a steering assembly 100 such as presented in the present disclosure is provided in a drill string, and the magnitude of the direction of drilling is changed by providing a side force on the said mandrel. In the said method, the tool face assembly can be operated for changing the tool face of the drill bit.

DETAILED DESCRIPTION

Figure 1A:
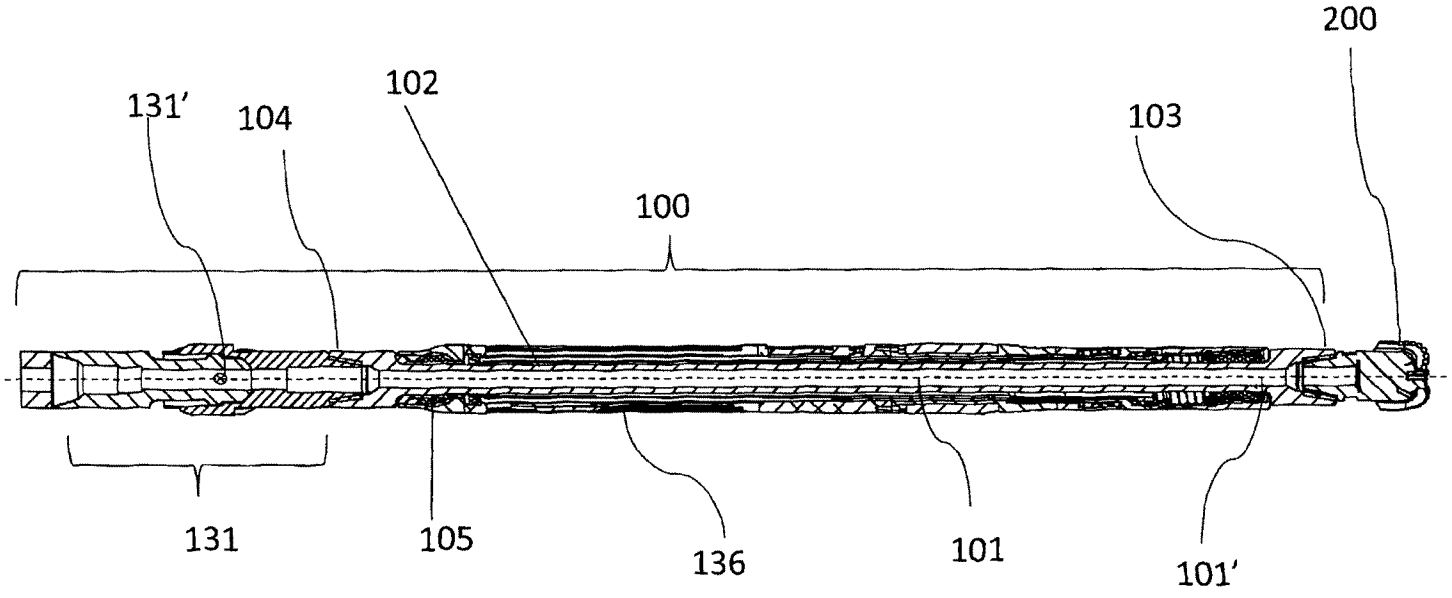
FIG. 1*a* shows a cross sectional view of a steering assembly according to an embodiment of the present invention, the steering assembly being connected to a drill bit.

According to a first aspect, the present invention relates to a steering assembly 100 to be included in a drill string for steering a drill bit in a directional wellbore.

A steering assembly according to the present invention comprises a housing 136 having a longitudinal axis 101 and a mandrel 102 comprising a front connecting extremity 103 for connection to a drill bit 200 and a rear connecting extremity 104 for connection to a drill string, the mandrel 102 passing through the said housing 136 and being arranged in a first position coaxially to the said longitudinal axis 101. The steering assembly being characterized in that it comprises:

- a deflector device for pivoting the said mandrel 102 in the housing 136 or in other words to give a side force on the mandrel such as to bring the said front connecting extremity 103 of the said mandrel 102 offset from the said longitudinal axis 101, and
- a tool face assembly for rotating the said front connecting extremity 103 of the said mandrel 102 towards a desired direction;

the said mandrel 102 being rotatable relative to the said housing, the said deflecting assembly and the said tool face assembly.

Preferably, the deflector device is a deflecting assembly as presented herein above. Alternatively, the deflector device can be any deflector device known by the man skilled in the art such as for example pistons or pads arranged in the housing 136 to push the mandrel 102 and actuated by an actuator.

The FIG. 1*a* presents a cross sectional view of an embodiment of a steering assembly configured in a "push the bit" mode. The term "push the bit" is used as reference to the configurations "push the bit" of the prior art steering systems wherein a side force is applied on the mandrel to change the offset of the mandrel relative to the axis of the housing. In the present invention, bending of the mandrel is minimized by connecting the rear extremity 104 of the mandrel 102 to a pivot stabilizer sub 131 such that when a side force is applied on the mandrel 102, the mandrel rotates relative to the pivot point and the front extremity 103 of the mandrel 102 gets offset from the axis of the housing. The front extremity of the mandrel is connected to a drill bit 200.

Advantageously, the pivot stabilizer sub 131 is arranged outside of the housing 136. This arrangement simplifies the construction and the manufacturing of the steering assembly, and the pivot stabilizer sub 131 can be removed and replaced easily. The pivot stabilizer sub 131 also gives more flexibility to the steering assembly and a wellbore can be drilled with higher doglegs.

Figure 1B:
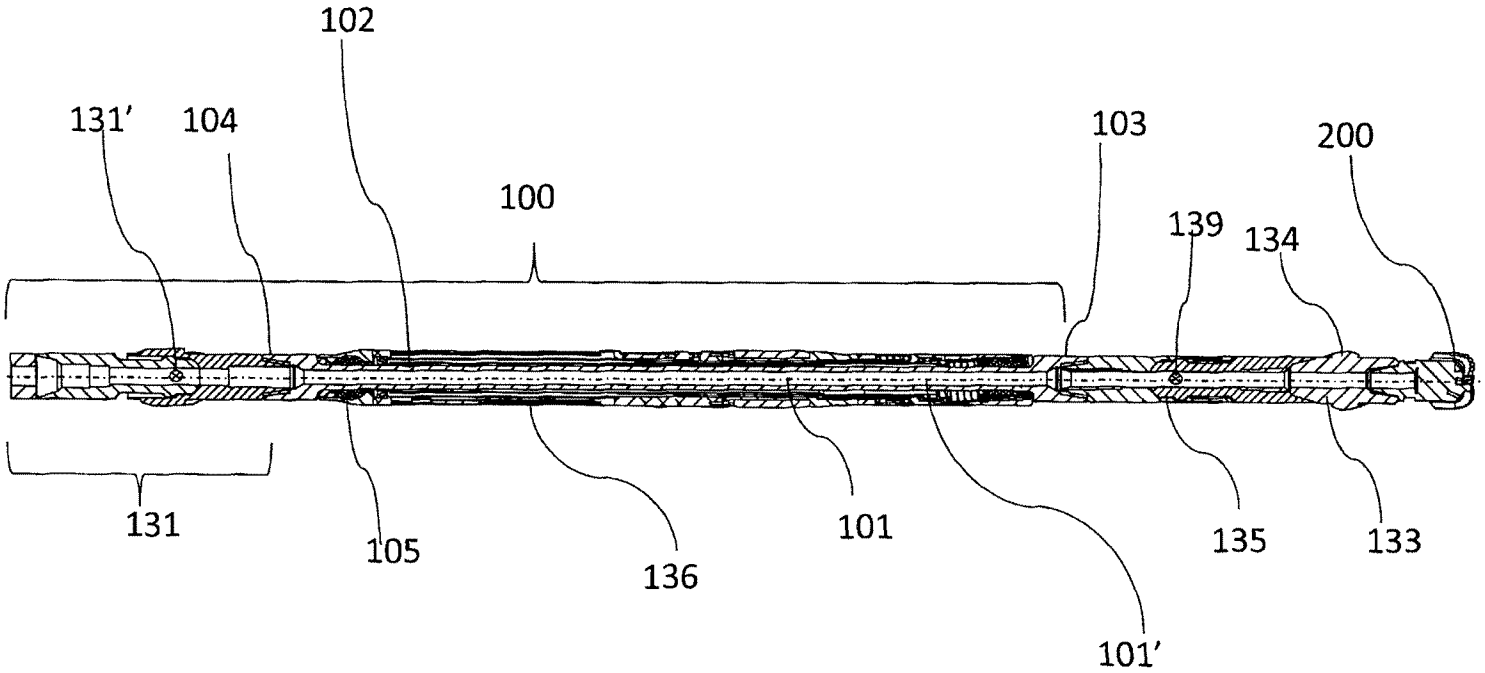
FIG. 1*b* shows a cross sectional view of a steering assembly according to an embodiment of the present invention, the steering assembly being connected to a pivot stabilizer sub itself connected to a drill bit.

The FIG. 1*b* presents a cross sectional view of a the same steering assembly represented in FIG. 1*a* with additional means arranged between the front end 103 of the mandrel 102 and the drill bit 200 such that the steering assembly is configured in a "point the bit" mode. The rear extremity 104 of the mandrel 102 is connected to a first pivot stabilizer sub 131 and the front extremity 103 of the mandrel 102 is connected to a pivot sub 135, which is connected to a near bit stabilizer 133, which is connected to a drill bit 200. The near bit stabilizer 133 has blades 134 located away from the pivot point 139 of the pivot sub 135, in order to obtain a better "point the bit effect" wherein the blades acts as a pad stabilizer preventing the side of the bit to cut the formation and maintaining borehole centralization at that point. In that configuration, when a force is applied on a lateral side of the mandrel 102, the mandrel rotates about the pivot point 131' of the pivot stabilizer sub 131, the front extremity 103 of the mandrel points towards a first direction at an angle $\alpha$ relative to the longitudinal axis 101 of the housing 136. The pivot sub 135 allows the drillstring to dislocate from the center or the wellbore. A fulcrum formed by the near bit stabilizer 133 and the wall of the wellbore causes the drill bit to point towards a second direction at an angle $\beta$ relative to the longitudinal axis 101 of the housing, wherein the angle $\beta$ is directly proportional to $\alpha$ but in the opposite direction, depending on the distance between the fulcrum point and the bit.

These both aforementioned configurations present the advantage that the mandrel 102 is not bent while applying changes to the orientation of the drill bit so that the fatigue on the mandrel is reduced, and therefore the durability of the steering assembly and the directional control of the drill bit are improved. Advantageously, the pivot sub 135 is also outside the housing 136 to simplify the construction of the steering assembly and to facilitate maintenance.

Figure 2A:
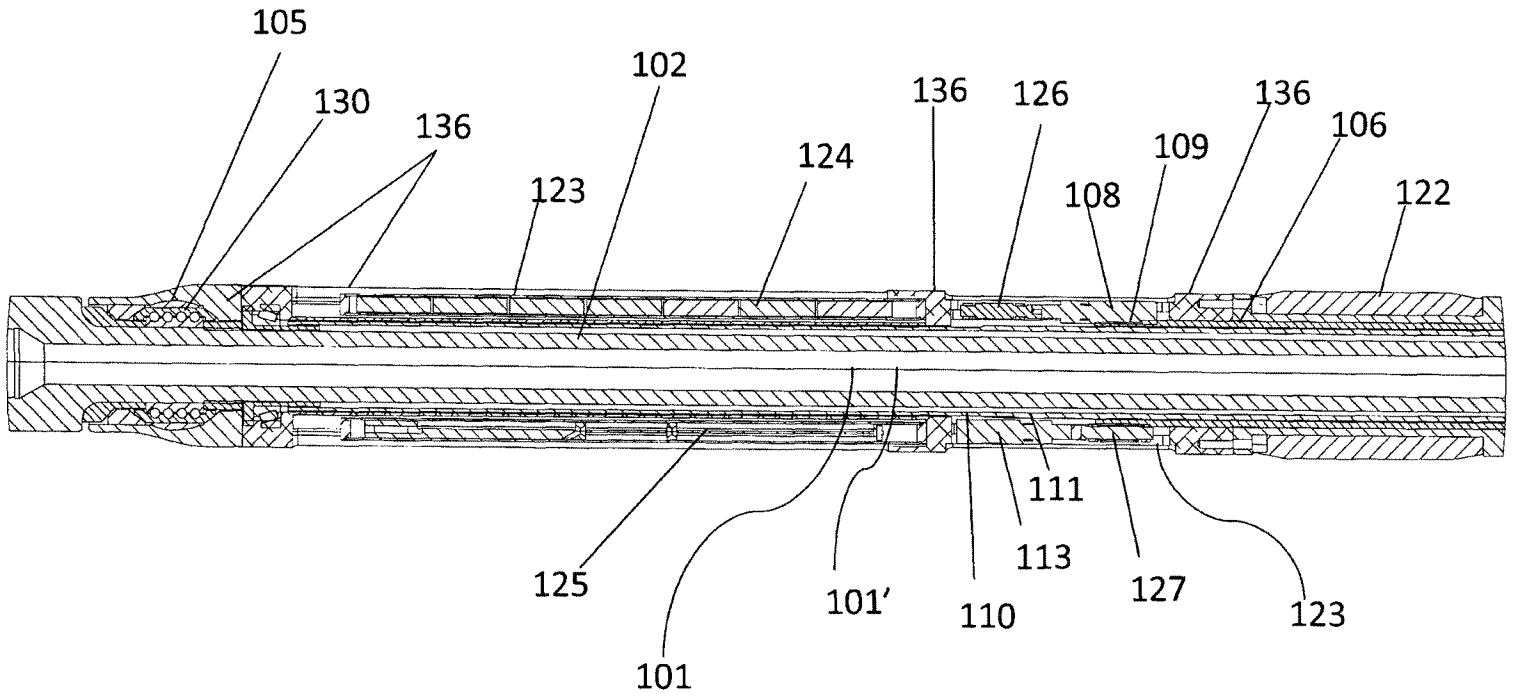
FIG. 2*a* shows an enlarged cross sectional view of a first section of the steering assembly according to the embodiments presented in FIGS. 1*a* and 1*b*.

The FIG. 2*a* shows an enlarged view of a first section of the steering assembly according to an embodiment of the present invention. The mandrel 102 is connected to the housing 136 through a bearing pack comprising a spherical seat 105 connected to the inner surface of the housing 136 and arranged around a set of ball bearings 130 that allows free rotation of the mandrel 102 relative to the housing 136. The spherical seat 105 is arranged between the mandrel 102 and the housing 136 such as to allow pivotal movement of the mandrel 102 relative to the housing 136 and provides radial and/or axial load coupling between the mandrel 102 and the housing 136. Preferably, the bearing pack is arranged in the vicinity of the rear end of the housing and the rear extremity 104 of the mandrel 102.

Figure 5:
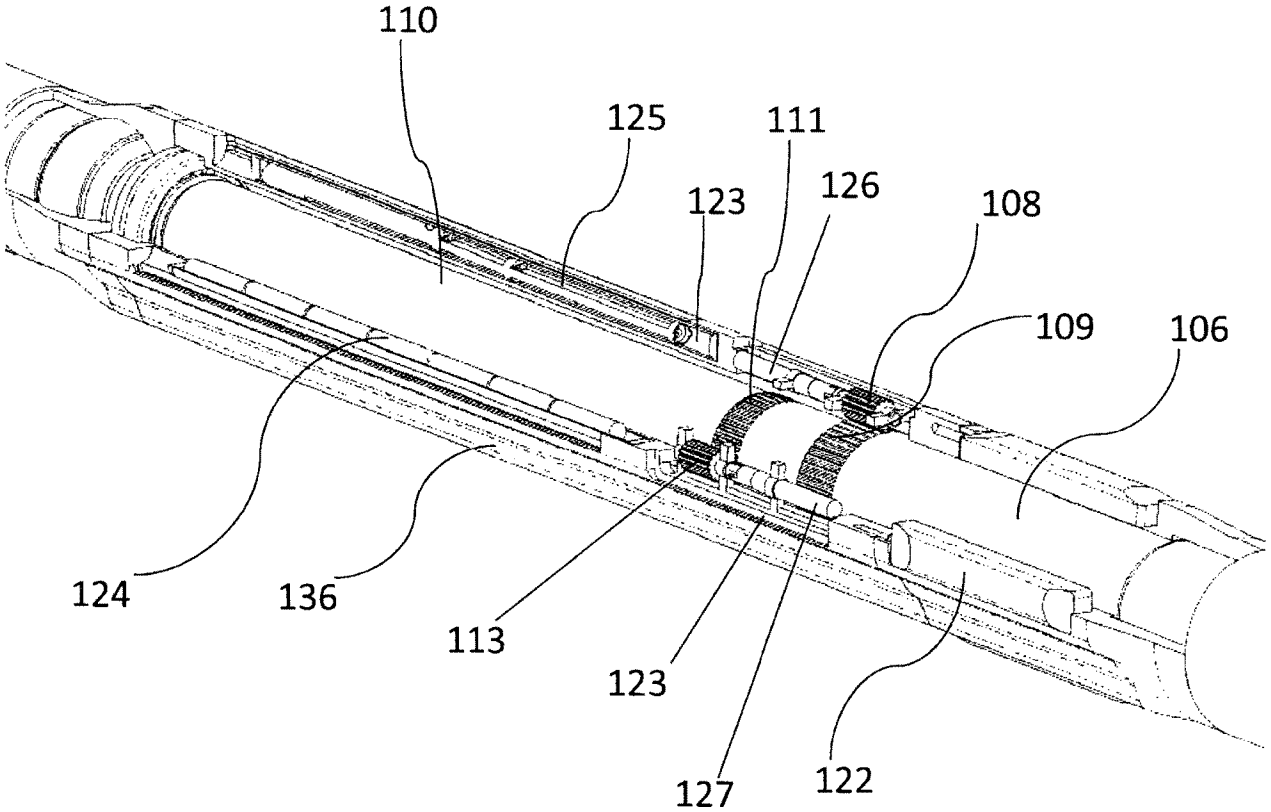
FIG. 5 shows a three dimensional view of the inside of the first section of the steering assembly presented in FIG. 2*a*.

A more detailed three dimensional view of the inside of the housing 136 is presented in FIG. 5. The housing 136 comprises compartments or enclosures 123 for arranging one or more batteries 124, control electronics assemblies 125 and motors 126 and 127 for communicating with the surface and operating the deflecting assembly and the tool face assembly.

Figure 2B:
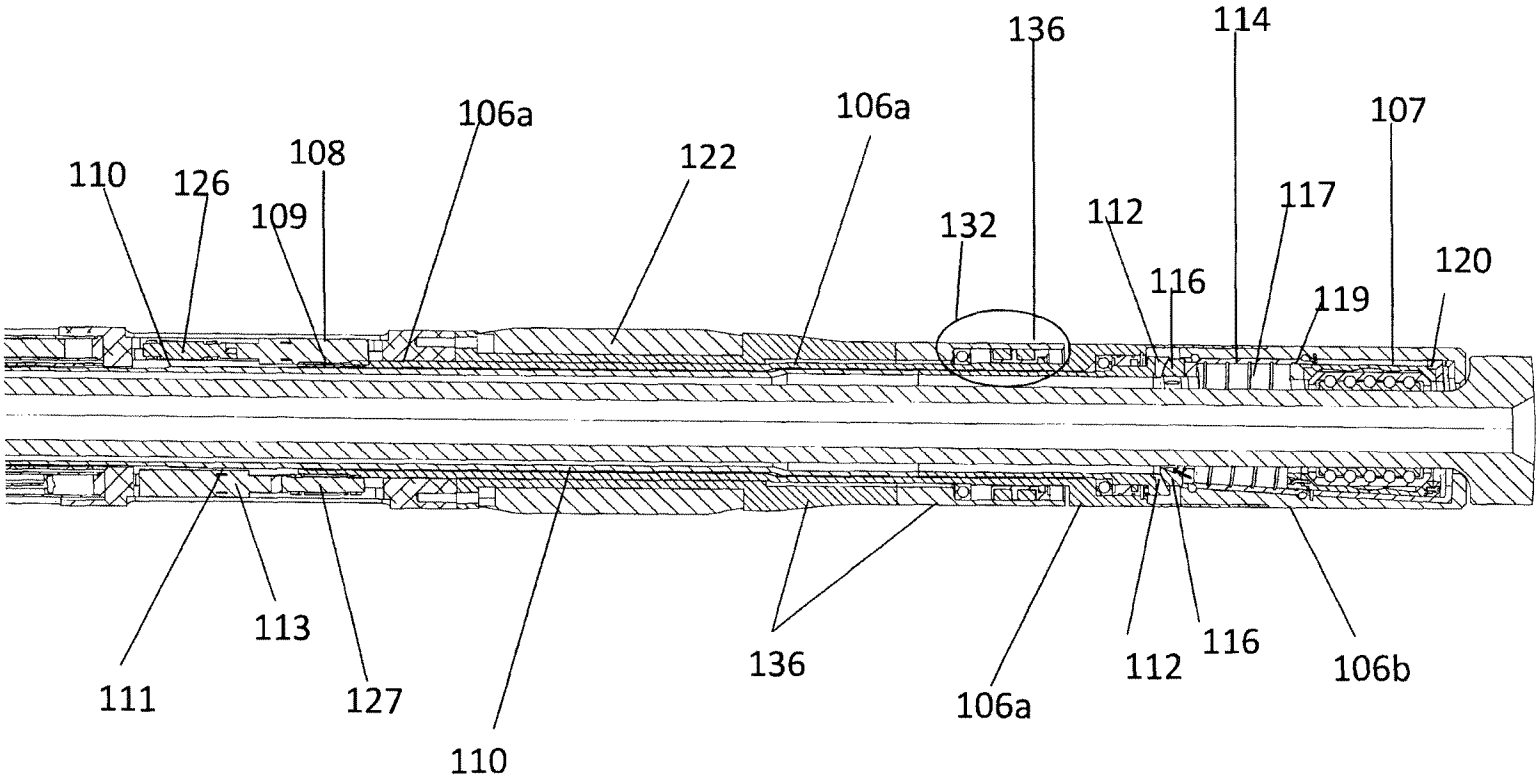
FIG. 2*b* shows an enlarged cross sectional view of a second section of the steering assembly according to the embodiments presented in FIGS. 1*a* and 1*b*.

The FIG. 2*b* represents an enlarged view of a second section of the steering assembly showing the tool face assembly and the deflecting assembly. The said tool face assembly comprises an orienting sleeve 106 included in the said housing 136 and arranged around the said mandrel 102. The orienting sleeve 106 comprises a first sleeve section 106*a* having a bore coaxial with the longitudinal axis 101 of the housing and a second sleeve section 106*b* having a bore coaxial to a second axis 137 which is inclined relative to the said longitudinal axis 101 of the housing. Preferably, the outer surface of the second sleeve section 106*b* is cylindrically coaxial to the longitudinal axis 101 of the housing 136 and has an outer diameter adapted to prevent debris of the wellbore to penetrate within the housing. For example, the outer diameter of the second sleeve section 106*b* is superior or equal to the outer diameter of the end of the housing 136 carrying the orienting sleeve 106. Alternatively, the outer diameter of the second sleeve section 106*b* may be substantially equal or superior to the inner diameter of the end of the housing 136 carrying the orienting sleeve 106. Because of the inclination of the bore of the second sleeve section 106*b* along the second axis 137, the outer diameter of the second sleeve section 106*b* is superior to the diameter of the first sleeve section 106*a* of the orienting sleeve. To provide a more compact steering assembly, it is preferable that the orienting sleeve 106 be partially included in the housing 136, with the first sleeve section 106*a* arranged inside of the housing 136 and the second sleeve section 106*b* arranged outside of the housing 136. Preferably, at least one bearing, preferably a thrust bearing 132 is arranged between the housing 136 and the orienting sleeve 106. The toolface assembly further comprises an actuating system for rotating the orienting sleeve 106, the actuating system comprising preferably a first geared actuator 108 that engages a geared surface 109 of the orienting sleeve. The first geared actuator 108 is arranged in the housing 136 and can be powered by a motor 126. The geared surface 109 is preferably arranged at the outer surface of the first sleeve section 106*a* inside the housing.

The deflecting assembly comprises a deflecting sleeve 107 arranged around the said mandrel 102 and coaxially to the said second axis 137. Preferably, the deflecting sleeve is arranged inside the second sleeve section 106*b* of the orienting sleeve 106. The deflecting assembly further comprises an actuating system for moving the said orienting sleeve 107 along the said second axis 137.

Figure 3:
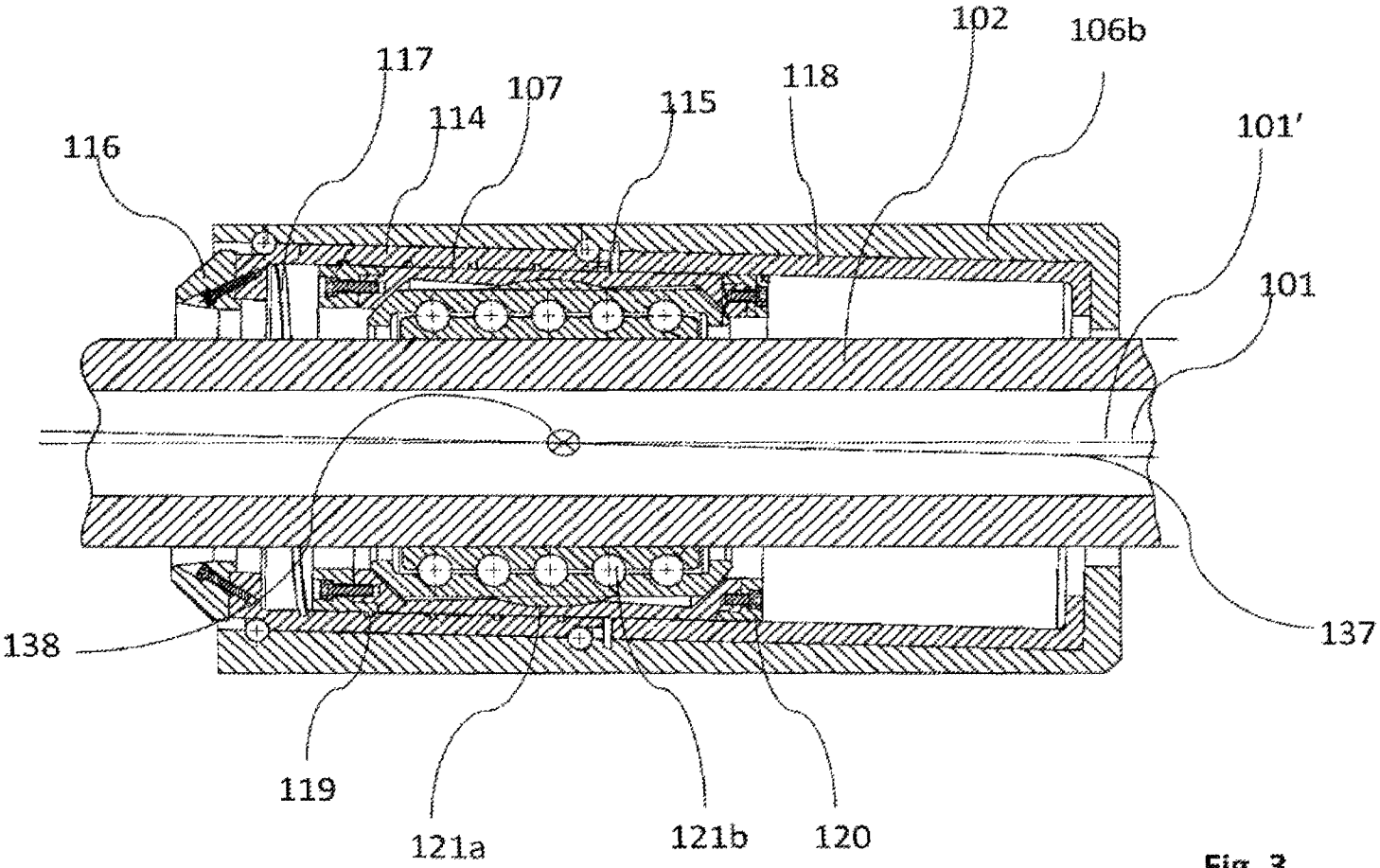
FIG. 3 shows an enlarged cross sectional view of a front section of the steering assembly according to the present invention.
Figure 4:
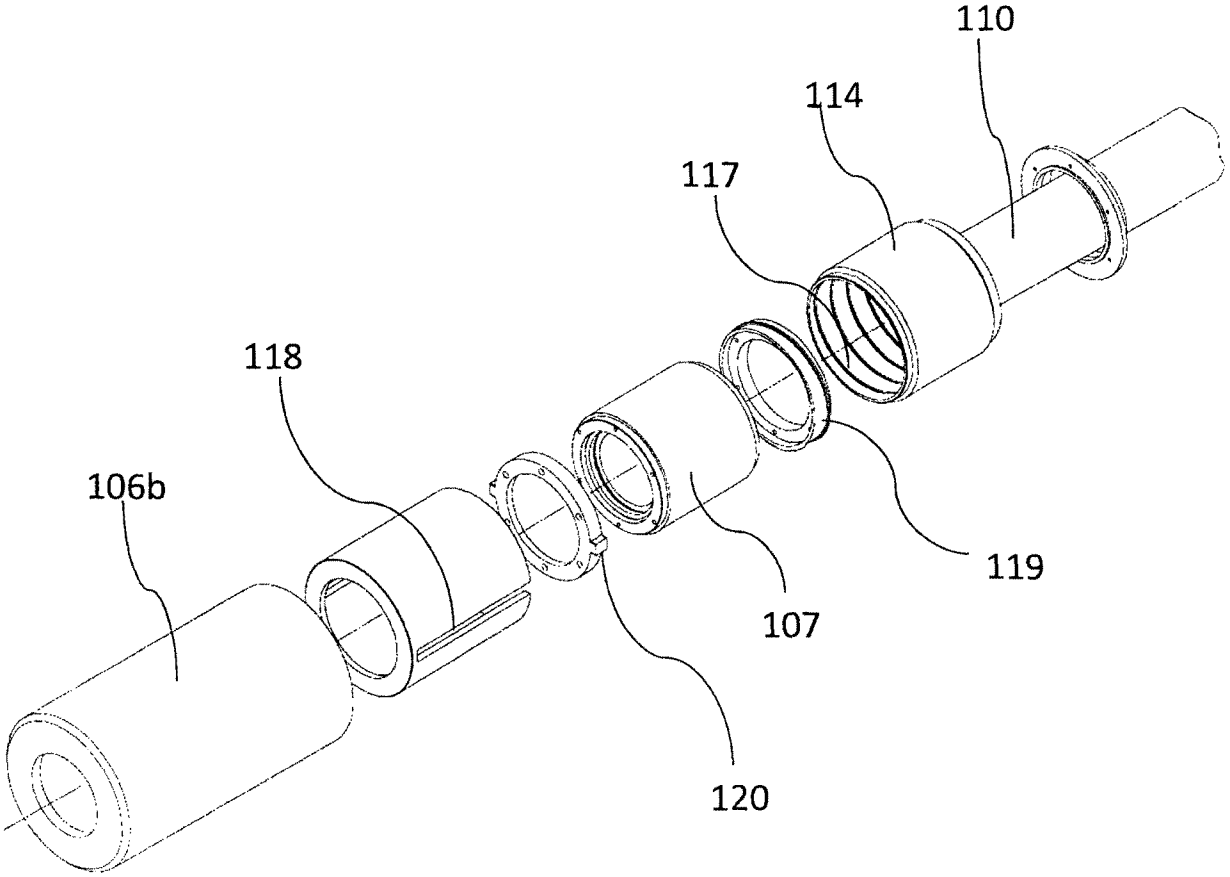
FIG. 4 shows a three dimensional exploded view of the front section of the steering assembly presented in FIG. 3.

An embodiment of an actuating system for moving the deflecting sleeve 107 is presented herein above in combination with the FIGS. 2*b*, 3 and 4. The actuating system for moving the deflecting sleeve 107 comprises a first actuating sleeve 110 that surrounds the mandrel 102 and that is at least partially included in the first sleeve section 106*a* of the orienting sleeve 106, so that the geared surface 111 can be engaged by a second geared actuator 113 arranged into the housing 136. The second geared actuator 113 can be powered by a second motor 127. The first actuating sleeve 110 further comprises a geared extremity 112 directed towards the bore of the second section 106*b* of the said orienting sleeve 106. A second actuating sleeve 114 is included inside the said second sleeve section 106*b* of the orienting sleeve 106, coaxially to the said second axis 137, and is retained by an abutment 115 into the said second sleeve section 106*b*. The second actuating sleeve 114 surrounds the said deflecting sleeve 107 which is disposed around the said mandrel 102. The second actuating sleeve 114 comprises:

- a geared extremity 116 that engages the said geared extremity 112 of the said first actuating sleeve 110 and;
- a spiral guiding means 117 provided on its the inner surface.

The said deflecting sleeve 107 comprises:

- a first side comprising a spiral cam follower 119 that engages into the said guiding means 117 in the second actuating sleeve 114;
- a second side comprising a linear cam 120 that engages with a linear guiding means 118 provided in the said second sleeve 106*b* section of the orienting sleeve 106.

The deflecting sleeve 107 is connected to the mandrel 102 through a bearing pack comprising a spherical seat 121*a* and ball bearing 121*b*. The spherical seat 121*a* is arranged between the said deflecting sleeve 107 and the ball bearing 121*b* itself arranged around the said mandrel 102. A clearance between the inner surface of the deflecting sleeve 107 and the outer surface of the ball bearing 121*b* allows a rotational movement of the ball bearing 121*b* relative to the deflecting sleeve 107, centered on the axis 138 of the spherical seat 121*a*.

To deflect the mandrel axis 101' relative to the axis 101 of the housing, instructions are sent to the control electronic assembly 125 for actuating the second geared actuator 113 to rotate the first actuating sleeve 110 whose geared extremity 112 engages the mating geared extremity 116 of the second actuating sleeve 114 inclined relative to the first actuating sleeve 110. Said instructions are sent to the control electronic assembly for example via telemetry transmitters. The inner surface of the second actuating sleeve 114 comprises a spiral guiding means 117 engaging the spiral cam follower 119 of the deflecting sleeve 107. The spiral cam follower 119 is preferably arranged on the rear side of the deflecting sleeve 107 oriented towards the first actuating sleeve 110. The front side of the deflecting sleeve 107 which is oriented towards the front end 103 of the mandrel 102 comprises a second cam follower 120 that engages within the linear guiding means 118 which is fixed in the second sleeve section 106*b* of the orienting sleeve. The linear guiding means 118 is prevented to rotate together with the second actuating sleeve so that the rotation of the second actuating sleeve 114 causes the deflecting sleeve 107 to translate along the said second axis 137 of the bore of the second sleeve section 106*b* of the orienting sleeve 106. This action deflects the mandrel 102 from a position parallel to the axis 101 of the housing 136 to a second position inclined relative to the axis 101 of the housing 136. The bearing pack arranged between the deflecting sleeve 107 and the mandrel 102 allows free rotation of the mandrel 102 relative to the deflecting sleeve 107 and to the orienting sleeve 106 and provides structural coupling between the parts.

Alternative embodiments of a deflecting assembly including various embodiment of a deflecting sleeve 107 and means for pushing the deflecting sleeve 107 along the said second axis 137 can be envisaged by the man skilled in the art such as for example a deflecting sleeve actuated by piston means or scissors powered by a motor.

To orient the mandrel 102 towards a desired direction or in other words to change the tool face of the drill bit, instructions are sent to the control electronic assembly 125, for example via telemetry transmitters, for actuating the first geared actuator 108 for rotating the orienting sleeve 106. The control electronics may also operate and provide directional control independent of surface commands via preprogrammed computer algorithms.

In a preferred embodiment of the present invention, the housing 136 of the steering assembly comprises an enclosure for a first motor 126 connected to the first geared actuator 108 dedicated for rotating the said orienting sleeve 106, and for a second motor 127 connected to the second geared actuator 113 dedicated for rotating the first actuating sleeve 110 of the actuating system for actuating the deflecting sleeve 107. In such an embodiment, it is therefore possible to send instructions for deflecting the mandrel at a desired offset position relative to the axis 101 of the housing 136 while rotating the mandrel 102 about the axis 101 of the housing 136 to orient the mandrel towards a desired direction, or in other words, to change the tool face of the mandrel towards a desired angle. Such a steering assembly provides a better control of the tool face orientation and provides borehole doglegs of better quality.

The housing 136 is advantageously configured for not rotating in the wellbore, for example by providing on the external surface of the housing a plurality of stabilizer pads 122 adapted to contact the walls of the wellbore. The pads 122 may have a rugged contact surface or can be made of rubber material to provide friction with the wall of the wellbore and preventing rotation of the housing. It is preferred that the housing 136 is in a position independent from the rotation of the mandrel, the tool face assembly and the deflecting assembly, such that the housing 136 serves as a reference point for steering. The steering assembly of the present invention allows an easier control of the tool face over the whole range of 360°. The steering assembly of the present invention also allows the offset of the front extremity of the mandrel to be varied to generate a variation of doglegs from small doglegs to high doglegs. The flexibility of the steering assembly is due to the pivot stabilizer and that creates a pivot point for the mandrel about which the mandrel rotates. This flexibility allows high doglegs.

Despite that the housing is configured for not rotating in the wellbore and is provided advantageously with stabilizer pads 122, it can happen that the housing accidentally rotates in the wellbore due for example to undesirable friction through the bearings. In order to prevent undesirable steering deviations, the housing 136 of the steering assembly is preferably equipped by a controller including accelerometers or other measuring means for measuring the deviation of the housing 136 relative to its initial tool face and the gravity vector. The controller is preferably included in the control electronics assembly 125, and is configured for measuring deviations of the housing angular position, for computing corrections to apply to the deflecting assembly and to the tool face assembly in order to steer the bit according to the desired direction and for applying these corrections to the deflecting assembly and to the tool face assembly.

A steering assembly 100 according to a second embodiment of the present invention comprises a housing 136 having a longitudinal axis 101 and a mandrel 102 comprising a front connecting extremity 103 and a rear connecting extremity 104, the mandrel 102 passing through the said housing 136 and arranged in a first position coaxially to the said longitudinal axis 101, a deflector device for giving a side force to the said mandrel 102 in the housing 136 such as to bring the said front connecting extremity 103 of the said mandrel 102 offset from the said longitudinal axis 101, characterized in that it further comprises a pivot stabilizer 131 connected to the rear extremity 104 of the mandrel. The pivot stabilizer sub 131 gives more flexibility to the steering assembly. The deflector device can be any deflector device known in the art such as a set of pistons or pads pushing the mandrel 102 offset from the longitudinal axis 101 of the housing 136, or the deflector device can be a deflecting assembly as disclosed herein above. Upon a side force on the mandrel 102, the mandrel 102 rotates about the pivot point of the pivot stabilizer and bending of the mandrel is prevented. Thanks to that feature also, a wellbore can be drilled with higher doglegs.

Preferably, the said pivot stabilizer is arranged outside of the housing 136. The steering assembly is simpler to build, comprises less parts in the housing, and removal of the pivot stabilizer sub is facilitated for maintenance.

In another configuration of the second embodiment of the invention, the front extremity 103 of the mandrel 102 is connected to a pivot sub 135 which is connected to a near bit stabilizer sub 133 which is connected to a drill bit 200.

Preferably, the said housing 136 is configured for not rotating within the wellbore and serves as a reference point for steering the bit.

Preferably, the steering assembly comprises:

a deflecting assembly for giving a side force to the said mandrel 102 into the housing 136 such as to bring the said front connecting extremity 103 of the said mandrel 102 offset from the said longitudinal axis 101, and a tool face assembly for rotating the said front connecting extremity 103 of the said mandrel 102 towards a desired direction;

the said mandrel 102 being rotatable relative to the said housing, the said deflecting assembly and the said tool face assembly.

Preferably, the steering assembly comprises a control device configured for measuring any undesirable rotation of the housing in the wellbore, calculating the correction to apply to steer the bit in the desired direction and to apply these corrections to the said deflecting assembly and tool face assembly.

Preferably, the tool face assembly and the deflecting assembly may comprise any one of the features listed herein above for the steering assembly according to the first embodiment of the present invention.

Preferably, the second embodiment of the steering assembly comprises any one of the features of the first embodiment of the present invention.

According to a second aspect, the present invention is related to a method for drilling directionally wellbore by providing in a drillstring a steering assembly 100 according to any one of the aforementioned embodiments, and wherein the direction of drilling is changed by operating the said deflecting assembly.

Preferably, the direction of drilling is further changed by operating the said tool face assembly.

More preferably, the direction of drilling is changed by operating in the same time the deflecting assembly and the tool face assembly.

In an embodiment of the method of the present invention, the steering assembly 100 is used in a push the bit configuration with the said front extremity 103 of the mandrel 102 connected to a drill bit 200.

In an alternative embodiment of the present invention, the steering assembly 100 is used in a point the bit configuration wherein the said front extremity 103 of the mandrel 102 is connected to a pivot sub 135 which is connected to a near bit stabilizer 133 having blades 134 away from the pivot point 139 of the pivot sub 135, the near bit stabilizer 133 being connected to a drill bit 200.

Also, a first section of a wellbore can be drilled by using the steering assembly in a push the bit configuration and a second section of a wellbore can be drilled by using the steering assembly in a point the bit configuration or inversely.

What is claimed is:

1. A steering assembly comprising:

a housing having a longitudinal axis;

a mandrel comprising a front connecting extremity and a rear connecting extremity, the mandrel passing through the housing and arranged in a first position coaxially to the longitudinal axis of the housing;

a deflector device disposed within the housing and configured to exert a side force on the mandrel to offset the front connecting extremity of the mandrel from the longitudinal axis, wherein the deflector device comprises a deflecting sleeve coaxial to a second axis inclined relative to the longitudinal axis of the housing; and a tool face assembly configured to rotate the front connecting extremity of the mandrel in a desired direction;

wherein the mandrel is rotatable relative to the housing, the deflector device and the tool face assembly, and wherein the deflector device and the tool face assembly are configured to move the deflecting sleeve along the second axis to exert the side force on the mandrel.

2. The steering assembly according to claim 1, further comprising a spherical seat arranged around a plurality of ball bearings configured to connect the mandrel to the housing.

3. The steering assembly according to claim 1, wherein an external surface of the housing further comprises bore contact pads.

4. The steering assembly according to claim 1, wherein the housing further comprises one or more enclosures including a battery, a control electronic assembly and a motor.

5. The steering assembly according to claim 1, further comprising a pivot stabilizer sub connected to the rear extremity of the mandrel.

6. A steering assembly, comprising:

a housing having a longitudinal axis;

a mandrel comprising a front connecting extremity and a rear connecting extremity, the mandrel passing through the housing and arranged in a first position coaxially to the longitudinal axis of the housing;

a deflector device configured to exert a side force on the mandrel to offset the front connecting extremity of the mandrel from the longitudinal axis, comprising a deflecting sleeve arranged around the mandrel and coaxially to a second axis inclined relative to the longitudinal axis of the housing, and a first actuating system for moving the deflecting sleeve along the second axis; and a tool face assembly configured to rotate the front connecting extremity of the mandrel in a desired direction, the tool face assembly further comprising:

an orienting sleeve at least partially included in the housing and arranged around the mandrel, the orienting sleeve comprising a first sleeve section having a bore coaxial with the longitudinal axis of the housing and a second sleeve section having a bore coaxial to the second axis; and a second actuating system for rotating the orienting sleeve comprising a first geared actuator that engages a geared surface of the orienting sleeve;

wherein the mandrel is rotatable relative to the housing, the deflector device and the tool face assembly.

7. The steering assembly according to claim 6, the first actuating system for moving the deflecting sleeve along the second axis further comprising:

a first actuating sleeve surrounding the mandrel and at least partially included in the first sleeve section of the orienting sleeve, the first actuating sleeve comprising:

a geared surface; and a geared extremity directed towards the second sleeve section of the orienting sleeve;

a second geared actuator that engages the geared surface of the first actuating sleeve;

a second actuating sleeve included in the second sleeve section of the orienting sleeve, retained by an abutment in the second sleeve section and disposed around the deflecting sleeve, the second actuating sleeve comprising:

a geared extremity that engages the geared extremity of the first actuating sleeve; and a spiral guide provided on an inner surface;

a linear guide provided in the second sleeve section of the orienting sleeve;

the deflecting sleeve further comprising:

a first side comprising a spiral cam follower that engages the spiral guide in the second actuating sleeve; and a second side comprising a second cam follower that engages the linear guide; and an assembly of a spherical seat and ball bearing arranged between the deflecting sleeve and the mandrel.

8. The steering assembly according to claim 7, further comprising a first motor connected to the first geared actuator dedicated for rotating the orienting sleeve, and a second motor connected to the second geared actuator dedicated for rotating the first actuating sleeve of the first actuating system and for actuating the deflecting sleeve.

9. A steering assembly, comprising:

a housing having a longitudinal axis;

a mandrel comprising a front connecting extremity and a rear connecting extremity, the mandrel passing through the housing and arranged in a first position coaxially to the longitudinal axis of the housing;

a deflector device configured to exert a side force on the mandrel to offset the front connecting extremity of the mandrel from the longitudinal axis, wherein the deflector device comprises a deflecting sleeve coaxial to a second axis inclined relative to the longitudinal axis of the housing;

a tool face assembly configured to rotate the front connecting extremity of the mandrel in a desired direction; and a pivot sub connected to the front extremity of the mandrel and connected to a stabilizer having one or more blades, the one or more blades extending away from the pivot point of the pivot sub, the stabilizer being connected to a drill bit;

wherein the mandrel is rotatable relative to the housing, the deflector device and the tool face assembly, and wherein the deflector device and the tool face assembly are configured to move the deflecting sleeve along the second axis to exert the side force on the mandrel.

10. The steering assembly according to claim 9, wherein the housing is configured not to rotate in a wellbore and serves as a reference point for steering the bit.

11. The steering assembly according to claim 9, further comprising a controller configured for measuring deviations in an angular position of the housing in a wellbore, calculating the correction to apply to steer the bit in the desired direction, and applying corrections to the deflector device and tool face assembly.

12. A method for directionally drilling a wellbore comprising:

providing in a drillstring a steering assembly comprising:

a housing having a longitudinal axis;

a mandrel comprising a front connecting extremity and a rear connecting extremity, the mandrel passing through the housing and arranged in a first position coaxially to the longitudinal axis of the housing;

a deflector device for giving a side force to the mandrel such as to bring the front connecting extremity of the mandrel offset from the longitudinal axis, wherein the deflector device comprises a deflecting sleeve coaxial to a second axis inclined relative to the longitudinal axis of the housing; and a tool face assembly for rotating the front connecting extremity of the mandrel towards a desired direction, wherein the tool face assembly comprises an orienting sleeve at least partially included in the housing and arranged around the mandrel; and wherein the mandrel is rotatable relative to the housing, the deflector device and the tool face assembly, and wherein the deflector device and the tool face assembly are configured to move the deflecting sleeve along the second axis to exert the side force on the mandrel; and operating the deflector device to change the magnitude of direction of drilling or operating the tool face assembly to change the direction of drilling or operating both of the deflector device and tool face assembly for changing the magnitude of direction of drilling and the direction of drilling.

13. The method according to claim 12, wherein the steering assembly is used in a push the bit configuration whereby the front extremity of the mandrel is connected to a drill bit.

14. The method according to claim 12, wherein the steering assembly is used in a point the bit configuration whereby the front extremity of the mandrel is connected to a pivot sub that is connected to a stabilizer that is connected to a drill bit.

15. A steering assembly comprising:

a housing having a longitudinal axis;

a mandrel comprising a front connecting extremity and a rear connecting extremity, the mandrel passing through the housing and arranged in a first position coaxially to the longitudinal axis of the housing;

a deflector device configured to exert a side force on the mandrel to offset the front connecting extremity of the mandrel from the longitudinal axis, wherein the deflector device comprises a deflecting sleeve coaxial to a second axis inclined relative to the longitudinal axis of the housing; and a tool face assembly configured to rotate the front connecting extremity of the mandrel in a desired direction;

wherein the deflector device and the tool face assembly are configured to move the deflecting sleeve along the second axis to exert the side force on the mandrel.

16. The steering assembly according to claim 15, wherein, when the side force is exerted on the mandrel, the front connecting extremity of the mandrel is offset from a first position that is parallel to the longitudinal axis to a second position that is inclined relative to the longitudinal axis.

* * * * *